US006490870B1

(12) United States Patent
Efremkine

(10) Patent No.: US 6,490,870 B1
(45) Date of Patent: Dec. 10, 2002

(54) HEAT TRANSFER APPARATUS AND METHOD

(75) Inventor: Vladimir Andreevich Efremkine, Moscow (RU)

(73) Assignee: Thermo Electric (Systems) Limited, West Midlands (GB)

( * ) Notice: Subject to any disclaimer, the term of this patent is extended or adjusted under 35 U.S.C. 154(b) by 0 days.

(21) Appl. No.: 09/463,123

(22) PCT Filed: Jul. 16, 1998

(86) PCT No.: PCT/GB98/02105

§ 371 (c)(1),
(2), (4) Date: Jun. 20, 2000

(87) PCT Pub. No.: WO99/04207

PCT Pub. Date: Jan. 28, 1999

(30) Foreign Application Priority Data

Jul. 19, 1997 (GB) ..... 9715146

(51) Int. Cl.[7] ..... F25B 21/02; B67D 5/62
(52) U.S. Cl. ..... 62/3.64; 62/393
(58) Field of Search ..... 62/3.3, 3.64, 389, 62/390, 391, 393, 396; 222/146.6

(56) References Cited

U.S. PATENT DOCUMENTS 3,058,620 A * 10/1962 Kromer
4,450,987 A * 5/1984 Boettcher et al. .... 222/146.6 X
4,679,408 A * 7/1987 Nelson ..... 62/390
4,804,118 A * 2/1989 Mullen et al. ..... 222/146.6 X
4,921,135 A * 5/1990 Pleet ..... 222/146.6 X
4,996,847 A 3/1991 Zickler
5,035,121 A * 7/1991 Cook ..... 62/389
5,094,088 A * 3/1992 Davis ..... 62/393
5,537,825 A * 7/1996 Ward ..... 62/3.64
5,590,532 A * 1/1997 Bachman ..... 62/3.3

FOREIGN PATENT DOCUMENTS

EP 0426092 5/1991
WO WO86 00064 1/1986
WO WO-8600064 A * 1/1986

* cited by examiner

*Primary Examiner*—Chen-Wen Jiang
(74) *Attorney, Agent, or Firm*—Baker Botts L.L.P.

(57) ABSTRACT

An apparatus for providing localized heat transfer to or from a beverage includes a beverage container for containing the beverage; a dispenser, for dispensing the beverage; a delivery apparatus, disposed between the beverage container and the dispenser, for continuously delivering the beverage from the beverage container to the dispenser; at least one heating/cooling unit including at least one Peltier junction, operationally coupled to the dispenser, for heating/cooling the beverage in the proximity of the dispenser; a heat-transfer agent, coupled to the at least one heating/cooling unit, for transferring heat from the at least one heating/cooling unit; a venting device, operationally coupled to the heat-transfer agent, for venting the transferred heat; and a power supply device, operationally coupled to the heating/cooling unit, for supplying power to the at least one Peltier junction.

27 Claims, 9 Drawing Sheets

HEAT TRANSFER APPARATUS AND METHOD

BACKGROUND OF THE INVENTION

1. Field of the Invention

This invention relates to an apparatus and a method for providing localised heat transfer (either for cooling or for heating a body).

2. Description of Related Art

Although the present invention will be described herein with particular reference to the chilling of a beverage, it finds much wider application. For example, quantities of paint (or similar material) could be kept warm so that they may be applied more readily; localised chilling may be provided at supermarket check-outs to keep foodstuffs (such as ice-cream) cold.

Referring now to the treatment of beverages, it is desirable that some beverages, particularly though not exclusively beers, lagers and milk, are chilled before they are consumed. Beverages are frequently dispensed from taps and it is sometimes desirable that such tap-dispensed beverages are chilled before (and/or as) they are dispensed.

Previous cooling systems for chilling tap-dispensed beverages, have comprised large chilled rooms into which barrels of the beverage are placed and allowed to equilibrate. Once the temperature of the barrel is in equilibrium with that of the room, the contents will have been chilled to an appropriate temperature. Further cooling has sometimes been provided in the vicinity of the dispensing taps to ensure that the beverage is dispensed at the optimum temperature.

For large establishments having a number of beverages on tap, the known arrangement requires that a large chilled room is provided. This is expensive to run and maintain and moreover the known cooling systems have generally used, as the cooling medium, hydrocarbon-derived gases, which can be harmful if vented to the atmosphere.

BRIEF SUMMARY OF THE INVENTION

The Applicants have now devised a method of and apparatus for cooling beverages at the point of dispensing (in addition to or in place of cooling at the point of storage). Advantages of the method and apparatus of the present invention have been found to include:

(i) Reduced energy costs;

(ii) Environmentally more acceptable;

(iii) Reduction of the space required for chilling drink at the bar and therefore more space for stock;

(iv) Accurate temperature control and cooling at the dispensing point.

According to a first aspect of the present invention, there is provided a method of localised heat transfer to or from a container in which a cooling/heating unit including at least one Peltier junction is brought into proximity with the container and a heat transfer means is operatively associated with the cooling/heating unit, whereby either heat is removed from the unit (should heat be removed from the container) or heat is provided to the unit (should heat be supplied to the container).

Thus, a single cooling/heating unit can be provided which can be placed adjacent to a container and the container can be heated or cooled as desired.

According to a second aspect of the invention, there is provided a cooling apparatus comprising a beverage containment means, one or more cooling units, a cooling means, a venting means and a power supply means, the or each cooling unit including at least one Peltier junction and being placed adjacent the beverage containment means, the cooling means being adapted, in use, to remove heat from the container, the venting means being adapted, in use, to remove heat from the cooling means and vent it to the atmosphere and the power supply means being connected to the or each cooling unit and being adapted, in use, to power the or each Peltier junction.

This has the advantage that a self-contained unit is provided which can be used to chill the beverage containment means (rather than relying on a chilled room as was previously the case).

The apparatus of the present invention can also be used out-of-doors; since cooling is not being performed in an enclosed environment (a room), the location of the beverage containment means has no significance.

Further, the overall cost of the cooling system is reduced. If a new hotel, bar, restaurant, or the like is being set up, the capital outlay for the known cooling systems would be very high. A cooling system according to the present invention can be developed and/or extended as required.

Preferably, insulating means are provided which insulate the beverage containment means from its surroundings. This has the advantage that heat is not as readily absorbed by the beverage from the surroundings. Energy consumption should therefore be reduced when compared to a system not having insulating means.

The beverage containment means may comprise a barrel (or similar bulk storage container) and a delivery means associated therewith.

The delivery means may comprise a duct, pipe or the like, such apparatus being well known to those skilled in the relevant art. The delivery means may additionally be provided with further cooling means (such as a water-jacket), especially insulated "Python" tubing.

The cooling unit may be placed in association with the barrel or it may be placed in association with the delivery means. This allows flexibility in the arrangement of the system.

In a preferred embodiment, more than one cooling unit is provided; at least one in association with the barrel and at least one in association with the delivery means.

Most preferably, the cooling unit provided in association with the delivery means is located at or near an end portion of the delivery means adjacent to where the beverage is dispensed.

The beverage may be a beer, a lager, a stout, a cider, a soft drink, or any other such beverage customarily dispensed from taps in public houses, restaurants, hotels, and similar establishments.

Preferably, a pumping means is provided to pump the beverage from the barrel through the delivery means to the dispensing point.

The cooling means may consist essentially of a cooling fluid, preferably water. Other fluids, such as hydrocarbon-derived gases, may be used. Fluids are relatively easy to handle and to use as coolants. It is particularly advantageous to use water as the cooling fluid as it is cheap, readily available, non-toxic, and non-polluting.

The cooling fluid may be continuously re-circulated so that the system is economic in its use of coolant.

The venting means may comprise a radiator, which is a particularly convenient way of loosing heat to the atmosphere. The radiator may be fan-assisted, thus providing a more compact venting means for the throughput of heat required.

Preferably the power supply means comprises a mains-fed transformer, thus providing a relatively secure source of power. The power supply means could alternatively or additionally (for example as a back-up supply) comprise one or more batteries.

The transformer can preferably provide 24V DC from a mains supply.

The apparatus may be adapted, in use, to deliver beverages chilled to a selectable temperature, for example −12° C. to +12° C. Normal temperatures at which beverages are dispensed are in the range +2° C. to +8° C.). It is desirable to be able to vary the temperature at which the beverage can be dispensed, so that the same apparatus can be used to dispense a variety of different beverages.

Preferably the pressure of the cooling fluid is less than 2.5 bar.

In an embodiment having more than one cooling unit, the cooling fluid may flow through each of the cooling units in turn. This has the advantage that only one cooling means is required per apparatus (as opposed to one for each cooling unit) thus making the apparatus much more cost-effective.

Preferably, the insulating means comprises a jacket which is adapted, in use, to surround the barrel. The jacket may have an opening means to allow the barrel to be inserted into the jacket.

The cooling apparatus may be manufactured from food-grade materials, possibly in accordance with prescribed (e.g. European) standards. This allows the beverage to contact the cooling apparatus and remain consumable.

The Peltier junction may comprise two regions of dissimilar types of semiconductor, such as an n-doped region and a p-doped region. Using dissimilar semiconductor materials in this manner provides suitable properties for the junction.

Preferably, each cooling unit comprises a thermoelectric module consisting of a plurality of p-type and n-type conductivity elements, the elements being held between a pair of ceramic plates or other insulating material. On passage of a current through the conductivity-elements, one of the plates acts as a heat-absorbing (cooling) surface and the other plate acts as a heat-releasing (heating) surface.

According to a third aspect of the invention there is provided a method of cooling a beverage comprising placing a cooling unit adjacent a containment means to remove heat from a beverage contained within the containment means, the cooling unit including at least one Peltier junction adapted to cause a cooling means to remove heat from the junction and to vent the removed heat to the atmosphere.

Such a method is advantageous since it is much more efficient than known techniques of cooling a beverage.

Preferably the method comprises cooling the beverage in the containment means from an ambient temperature to a chilled temperature by using the cooling unit and subsequently maintaining the beverage at the chilled temperature. This has the advantage that the cooling of the beverage does not need to be completely performed as the beverage is dispensed. Thus, the power required for the cooling unit can be reduced.

The method may comprise cooling the beverage from an ambient temperature of 25–35° C. down to the chilled temperature of 10° C. or lower. For example, the chilled temperature may be set to be 8° C., or 6° C., or 4° C., or 2° C.

Preferably, beer can be dispensed from the beverage containment means through a delivery means and the delivery rate may be at least 600 $cm^3$ per minute. More preferably, the delivery rate may be about 1200 $cm^3$ per minute and most preferably is at least 2400 $cm^3$ per minute. Of course, the flow rate could be higher, perhaps 3000 $cm^3$ or 4000 $cm^3$ per minute. It has been found that these flow rates provide a convenient rate at which to dispense a beverage.

The method may further comprise continuously dispensing a beverage from a beverage containment means.

The beverage in the containment means may be cooled from the ambient temperature to the chilled temperature in from 6 to 14 hours, dependent on the starting temperature.

According to a fourth aspect of the invention there is provided the use of a cooling unit including at least one Peltier junction to cool a beverage.

The present invention will be illustrated, merely by way of example, in the following description and with reference to the accompanying drawings.

BRIEF DESCRIPTION OF THE SEVERAL VIEWS OF THE DRAWINGS

In the drawings (wherein like numerals denote like parts),

(Note: FIGS. 2B and 2C are, respectively, sections on lines A—A and B—B of FIG. 2A).

(FIG. 10A is a section on line 10A—10A of FIG. 10B and FIG. 10C is a section on line 10C—10C of FIG. 10D);

DETAILED DESCRIPTION OF THE INVENTION

Figure 1:
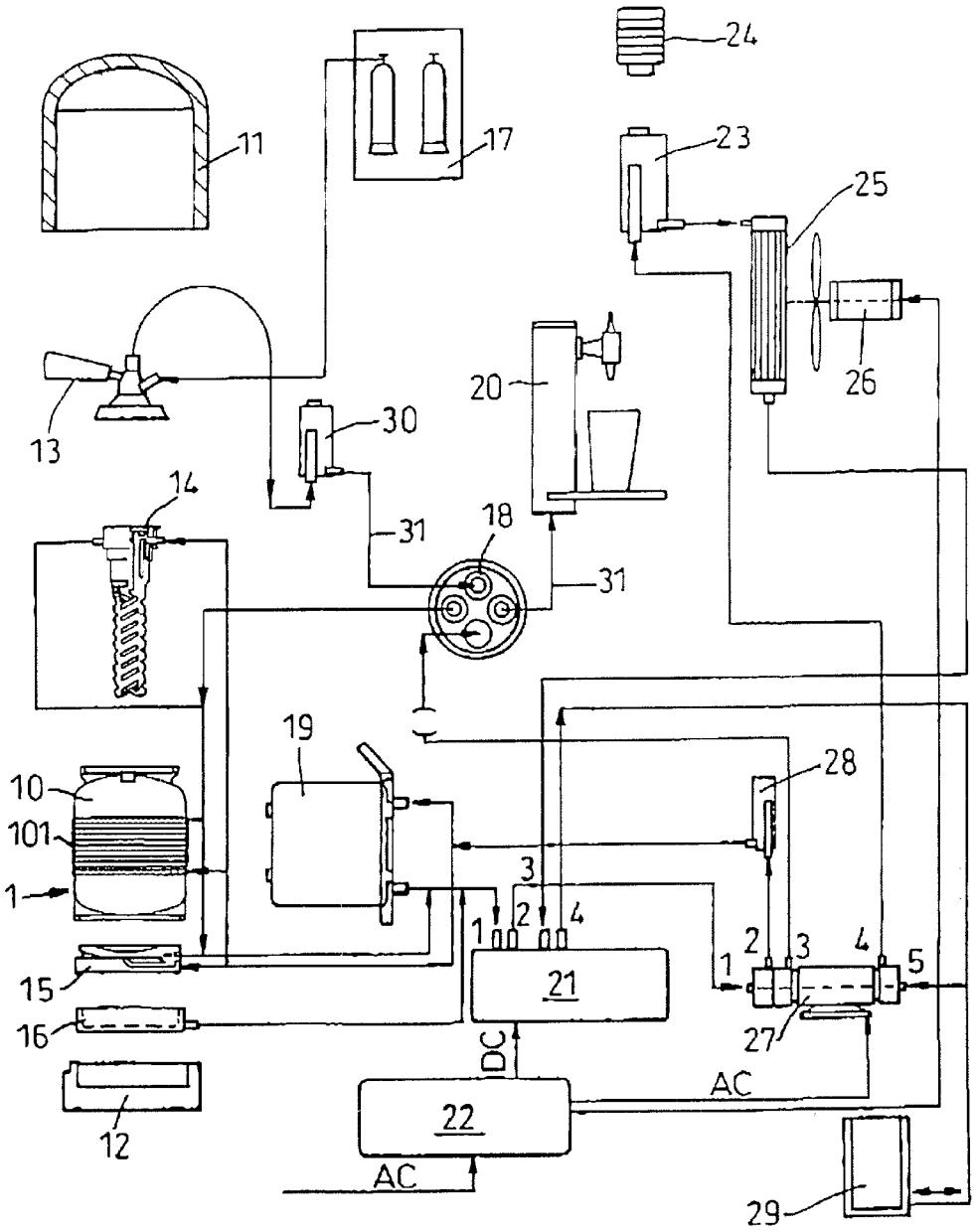
FIG. 1 is a schematic diagram of an apparatus according to the present invention for dispensing a chilled beverage.

Referring now to FIG. 1, there is shown a beverage container 1 comprising a barrel 10 having an insulating cover 11 and insulating base 12. An extractor-tube type heat exchanger 14 is inserted into the barrel 10 and a dispenser head 13 is provided to permit the transportation of beverage from the barrel 10 to a dispenser unit 20, via a fob detector 30 and tubing 31. A heat exchanger 15 is placed in contact with the base of the barrel 10 and a hermetically-sealed "cold" tank 16 is placed between the heat exchanger 15 and insulating base 12. A further heat exchanger 101 is mounted on the barrel 10 itself.

Movement of the beverage through tubing 31 from the barrel 10 to the dispenser unit 20 is assisted by means of a gas supply shown schematically at 17. Circulation of a cooling fluid (e.g. water) through the system, together with movement of the beverage from the barrel to the dispenser unit, is suitably achieved by means of a thermo-insulated multibore tubing (shown schematically at 18), for example a "Python" tubing of a type known per se.

The barrel 10 is further provided with an external heat-exchanger 19 for chilling the beverage.

Electrical control of the apparatus is achieved by means of a thermoelectric block 21, in operative association with a regulator 22.

Cooling fluid (e.g. water) is circulated around the apparatus. From an expansion tank 23 provided with a gas compensator 24, the fluid passes through a radiator 25 having an external fan 26. Circulation of the fluid is achieved by means of a pump 27. An air extractor (shown schematically at 28) is also provided and the cooling circuit also includes a hermetically-sealed "hot" tank 29.

Figure 2A:
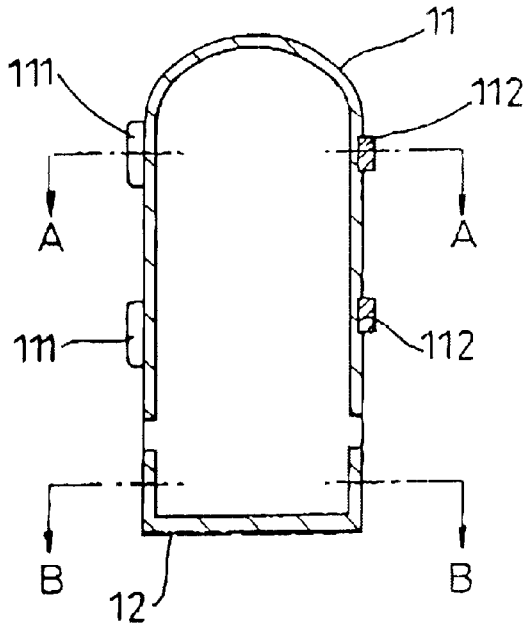
FIGS. 2A, 2B and 2C show a suitable construction for an insulating cover and base for the beverage container of the apparatus of FIG. 1.
Figure 2B:
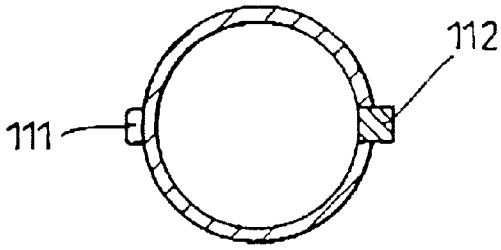
Figure 2C:
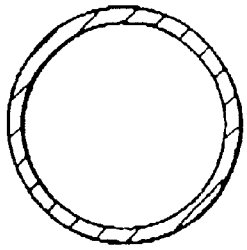

With reference to FIGS. 2A, 2B and 2C, the insulating cover 11 and base 12 for the barrel 10 of FIG. 1 are suitably provided with catches 111 and hinges 112 for ease of access to the barrel.

Figure 3C:
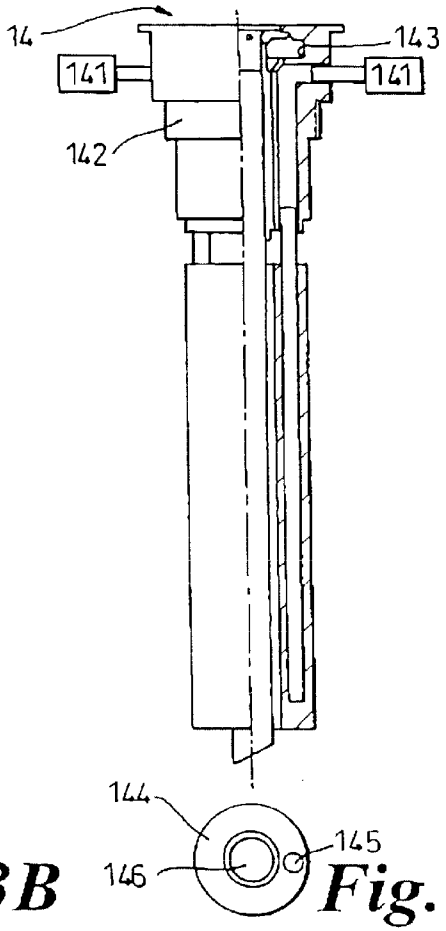
FIGS. 3A, 3B and 3C show different types of heat-exchanger adapted in use to be inserted into the beverage container of the apparatus of FIG. 1.
Figure 3B:
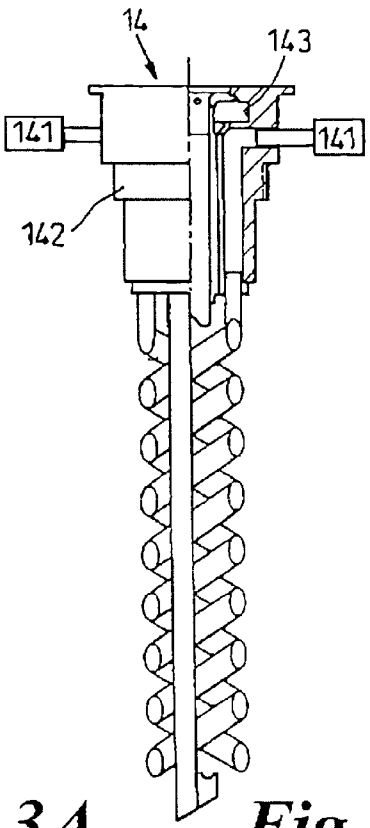
Figure 3A:
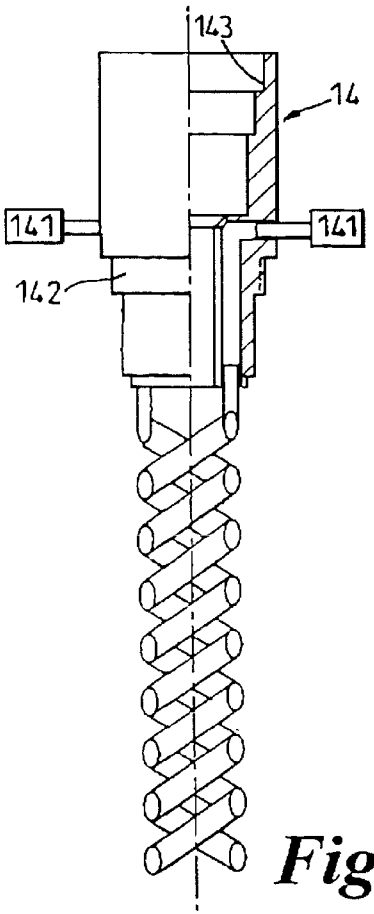

In FIGS. 3A, 3B and 3C, three different types of heat exchanger, adapted to be inserted into the barrel 10 of FIG. 1, are shown:

FIG. 3A shows an insert 14 having a spiral-tube heat exchanger, which screws into the barrel by means of union 141 and threading 142. An extractor tube is adapted to be attached at 143.

FIG. 3B shows a similar insert to that of FIG. 3A, in which the spiral tube carries a heat-transfer medium which also serves as a spring for an extractor valve.

FIG. 3C shows an insert which includes a cavity 144 for the heat-exchanger, a tube 145 for the heat-transfer medium and a tube 146 by way of which heat can be removed from the system.

Figure 4A:
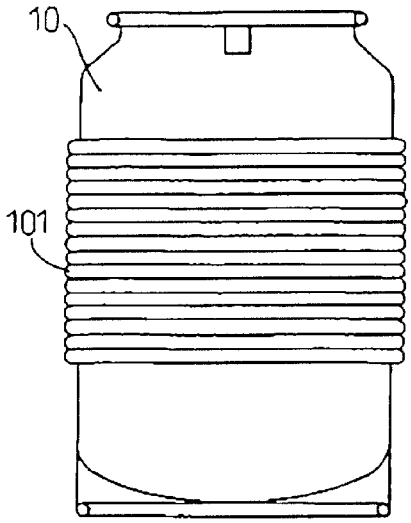
FIGS. 4A, 4B and 4C show different types of heat-exchanger adapted in, use to be mounted on the beverage container of the apparatus of FIG. 1.
Figure 4B:
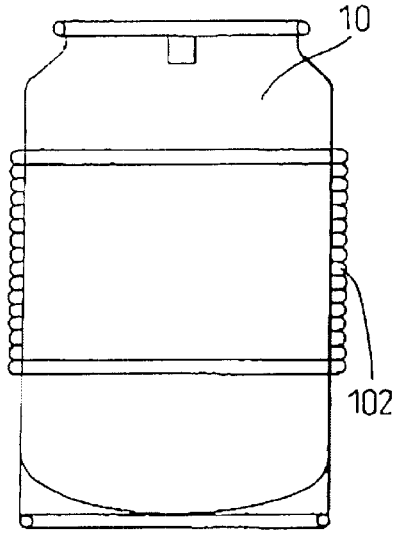
Figure 4C:
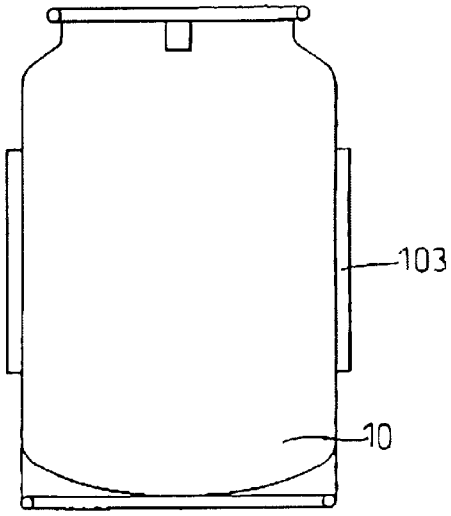

FIGS. 4A, 4B and 4C show different barrel-mounted heat-exchangers:

In FIG. 4A there is shown a heat exchanger 101 having a spiral, hermetically sealed cavity to contain a coolant. The exchanger 101 also acts as a structural stiffener for the barrel.

In FIG. 4B there is shown a spiral pipe 102 to contain a coolant.

In FIG. 4C the barrel 10 is itself provided with a hermetically sealed cylindrical cavity 103 to contain a coolant. The cavity 103 also acts as a structural stiffener for the barrel.

Referring now to FIGS. 5A to 5D, there is shown two types of heat-exchanger 15 suitable for location at the base of the barrel 10 of FIG. 1.

Figure 5A:
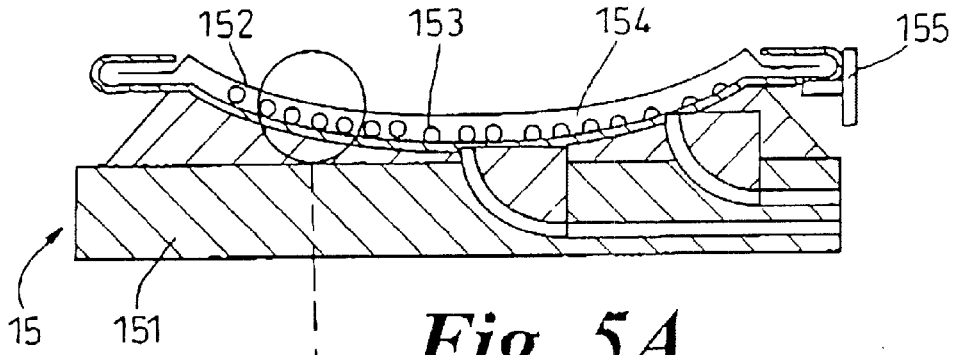
FIGS. 5A, 5B, 5C and 5D show different types of heat-exchanger adapted in use to be placed at the base of the beverage container of the apparatus of FIG. 1.
Figure 5B:
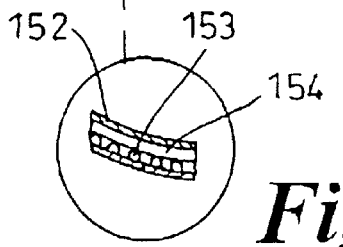

In FIGS. 5A and 5B the heat-exchanger 15 comprises a base 151 on which is mounted an elastic membrane 152 containing a tubular heat exchanging means 153. A mass 154 of a thermally-conductive material (which may be a gel, a fluid, a suspension of paste or a powder) is placed between the membrane 152 and the means 153.

Figure 5C:
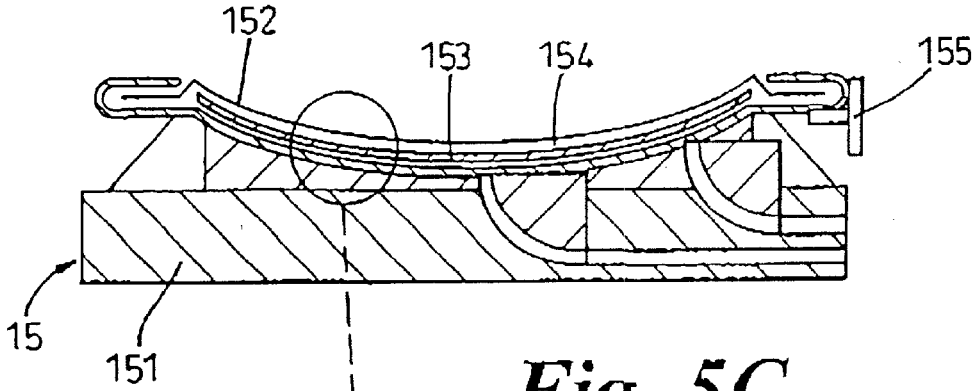
Figure 5D:
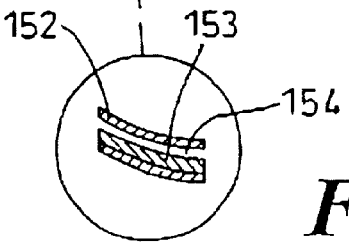

In FIGS. 5C and 5D the heat-exchanger 15 again comprises a base 151 on which a hollow elastic membrane 152 is mounted. The effective heatexchanger consists essentially of a part-spheroidal cavity 153. A mass 154 of a thermally-conductive material is again placed between the membrane 152 and the cavity 153.

The heat-exchanger 15 is operatively attached to the apparatus by means of a fixing unit shown schematically at 155.

Figure 6:
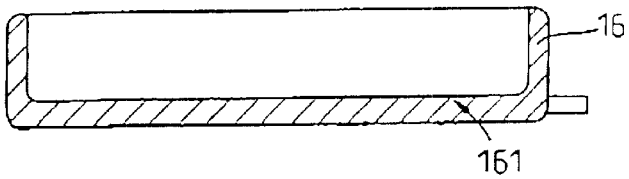
FIGS. 6 and 7 show, respectively, hermetically sealed tanks for use in connection with "cold" and "hot" circuits for a cooling fluid for the apparatus of FIG. 1.
Figure 7:
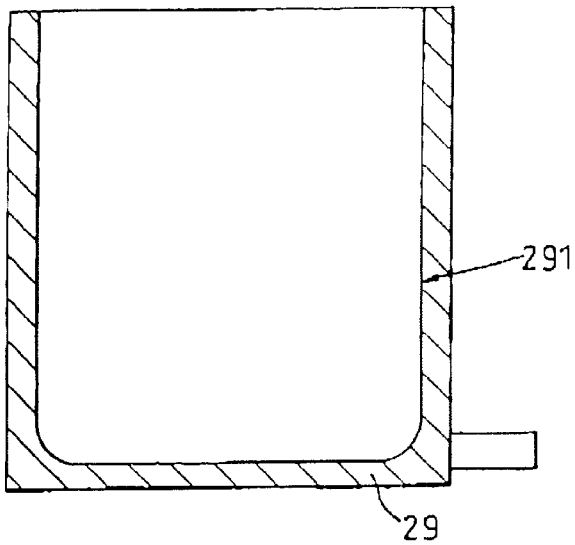

Referring to FIGS. 6 and 7, a tank 16 (for the "cold" circuit) and a tank 29 (for the "hot" circuit) are respectively provided with a flexible membrane 161 and 291, the membrane forming one of the walls of each tank. When the apparatus is switched off, water returns under gravity to the tanks. Suitably, the membrane 161 (291) may be formed from a condom-type material.

Figure 8A:
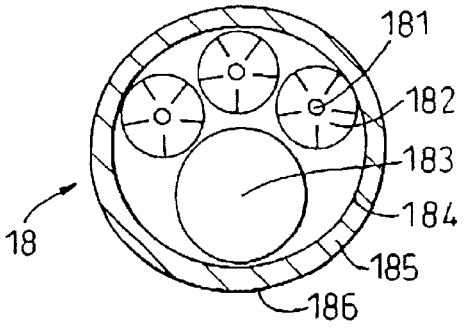
FIGS. 8A, 8B and 9 show different types of "Python" multibore tubing suitable for use in connection with the apparatus of FIG. 1.
Figure 8B:
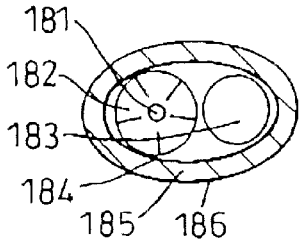

In FIGS. 8A and 8B, two types of "Python" multibore tubing are shown. Generally, the inner tube 181 carries the beverage and the outer tube 182 carries the coolant, but both may be used for circulating the beverage through the apparatus. The tubes 181 and 182, together with a flow line 183 for the coolant, are enclosed within respectively co-axial protective layers of a plastics material 184, a foam material 185 and a plastics outer skin 186. The cross-sectional area of the flow line 183 should in each case be equal to that of the outer tube(s) 182, less that of the inner tube(s) 181, irrespective of the number of inner tubes.

Figure 9:
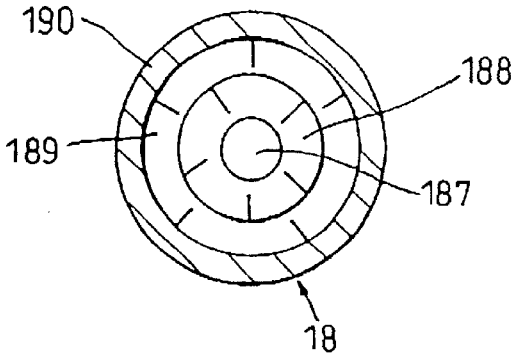

In FIG. 9 there is shown an alternative "Python" tubing, comprising a product tube 187, a gilled return tube 188, a gilled flow tube 189 and an insulating layer 190, all tubes being arranged co-axially.

Figure 10A:
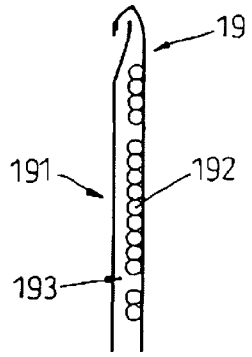
FIGS. 10A, 10B, 10C and 10D show different constructions of heat-exchangers for contact, in use, with the beverage container of the apparatus of FIG. 1.
Figure 10B:
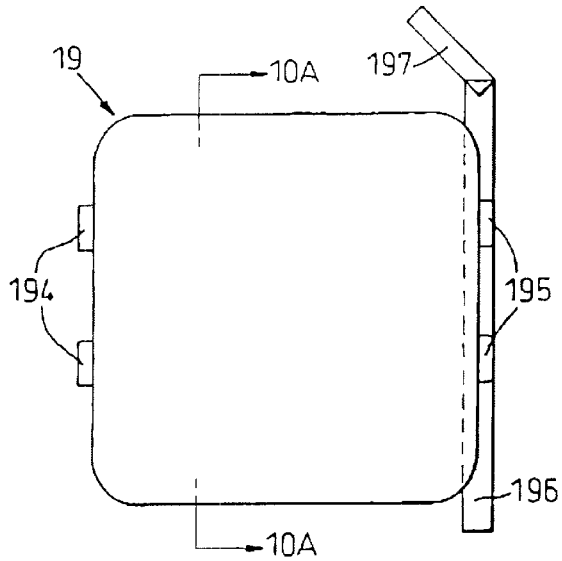

FIGS. 10A and 10B show a first type of external heat-exchanger 19 for use in the apparatus of FIG. 1. The exchanger 19 is provided with a generally tubular means 192 to contain the heat transfer medium, the means 192 being enclosed in a membrane 191. The space between the membrane 191 and tubular means 192 is filled with a mass 193 of a thermally conductive material. Locks, hinges, a stand and an attachment for a temporary tap are shown respectively at 194, 195, 196 and 197.

Figure 10C:
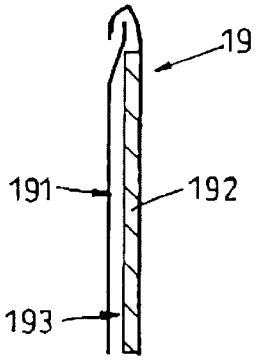
Figure 10D:
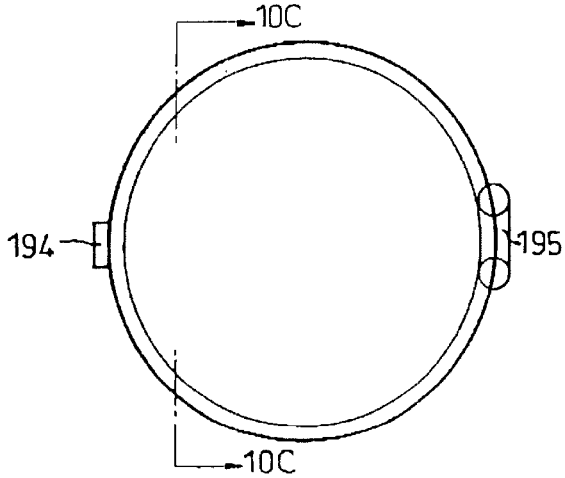

In FIGS. 10C and 10D there is shown an alternative type of heat-exchanger 19, in which the membrane 191 encloses a generally flat cavity 192 to contain the heat transfer medium. A mass 193 of a thermally conducive material is placed between the membrane and the cavity.

Figure 11:
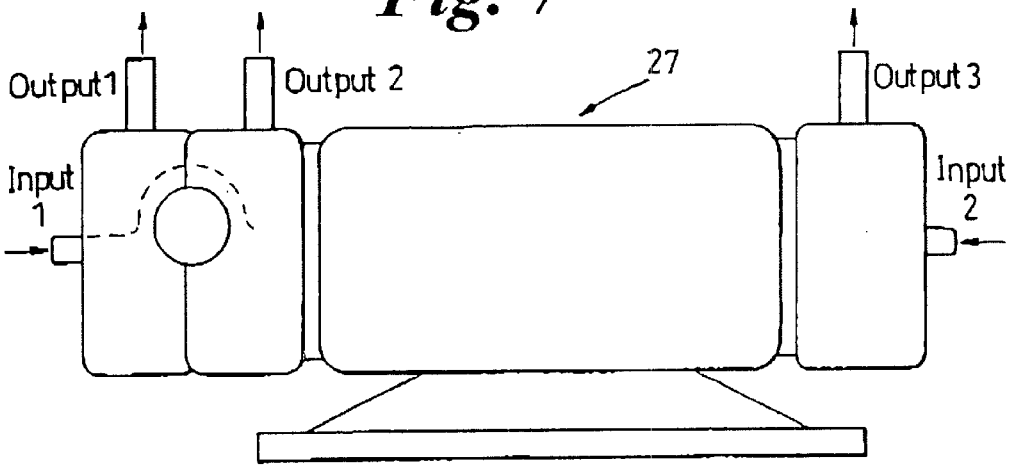
FIG. 11 is a centrifugal pump for use in connection with the apparatus of FIG. 1.

Referring now to FIG. 11, the centrifugal pump 27 has at least three sections: at least two sections are connected in series and have one input and two outputs operating at different pressures. At least one section is self-contained relative to the other sections. All sections are insulated from heat and all may conveniently be driven by means of a single electric motor.

As illustrated in FIG. 1, the barrel 10, the several heat-exchangers, gas supply 17 and pump 27 are all located in a cellar. The dispensing unit 20 may be located in a bar area. The skilled person will appreciate that while it is of no significance where some parts of the system are located (for instance the pump 27), other parts will generally always be located in a certain place (for instance the dispensing unit 20 will generally always be located in a bar area). Other parts (e.g. the pipes carrying the various fluids) will need to pass through both areas.

In use, beer is delivered to the apparatus in barrels 10 which are at an ambient temperature, typically 25° C. The un-cooled barrel 10 is placed into the apparatus. Once the barrel is in place the apparatus is activated.

The pump 27 is switched on, thus circulating cooling water. Heat is drawn from the barrel 10 by the heat-exchangers and is transferred to the cooling water, thus raising the temperature of the cooling water.

The pump 27 forces the cooling water through the radiator 25 which dissipates the heat transferred to the water. The fan 26 assists in this process.

Gradually the temperature of the beer within the barrel 4 falls and after 6–14 hours the temperature has been reduced to the required temperature. The temperature selected depends on the beer contained within the barrel, but may suitably be in the range 8° C. to 2° C.

Once the beer has been sufficiently cooled it can be dispensed through the dispensing unit 20. This is achieved by activating the beer pump 13, drawing beer from the barrel 10 towards the dispensing unit 20.

Suitably, the thermo-electric block may include a further block (hereinafter BPSR) which combines a power source and a regulator (both known per se).

Preferably, the BPSR has a substantially flat configuration for ease of mounting into the thermo-electric block. The components of the BPSR, together with any covering and/or housing, are preferably made from a non-corrosive material and all surfaces of the BPSR should be smooth and without corrosion or other damage.

Preferably, the dimensions and weight of the BPSR are reduced to a minimum, for example a height not exceeding 40 mm and a volume not exceeding 650 $cm^3$.

Suitably, the resistance of insulation current circuits between the BPSR and any electrically-isolated circuits is not less than 20 MΩ (at 45–80% relative humidity and ambient temperature from +20° C.) and 1 MΩ (at 92–98% relative humidity and ambient temperature from +20° C.). All inner and outer circuits are separated and have no galvanic connection with the BPSR or with each other. Power may conveniently be supplied from A.C. mains and preferably the power consumption should not exceed 950 W. Preferably, the BPSR includes a safety device (e.g. a fuse) to protect against short-circuit or overheating of the thermo-electric block (for example, in the event of insufficient coolant in the block).

Preferably, the regulator is capable of maintaining the coolant temperature in the circuit to within ±0.5° C. of a given temperature in the range −1 to +10° C.

Maintenance of the required temperature may be achieved by means of a temperature-sensor in the cold circuit, together with a control circuit and the power source.

For example, a given temperature (Tg) in the cold circuit can be maintained by one of two possible methods so that the relationship of the temperature (Tc) of the cold circuit and the temperature (Th) of the hot circuit to the given temperature is Tc<Tg<Th (±0.5° C.):

Method (i) Reducing the voltage of the thermo-electric block to zero and supplying nominal voltage at Tg>Tc;

Method (ii) Reducing the voltage of the thermoelectric block to 65% of the nominal voltage at Tc<Tg and supplying nominal voltage at Tc>Tg.

Maintenance of the temperature (Th) of the hot circuit is suitably achieved by means of a temperature-sensor in the hot circuit which acts to switch on a hot circuit pump. The sensor acts to break the contacts of the hot circuit pump relay when Th<Tg and to close the contacts when Th>Tg (±1° C.).

Preferably, the working mode of the BPSR is continuous and the block should function correctly at temperatures of between +10° C. and +32° C. As well as complying with applicable safety standards, the BPSR is suitably designed so that incorrect electrical connection is virtually impossible.

Figure 12:
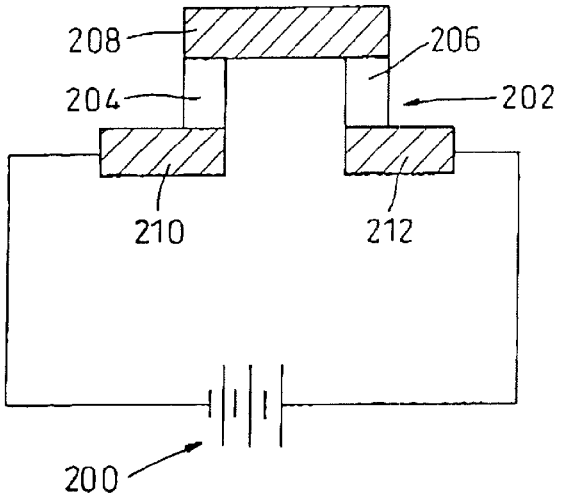
FIG. 12 is a schematic diagram of a Peltier junction for use in the apparatus of FIG. 1.
Figure 13:
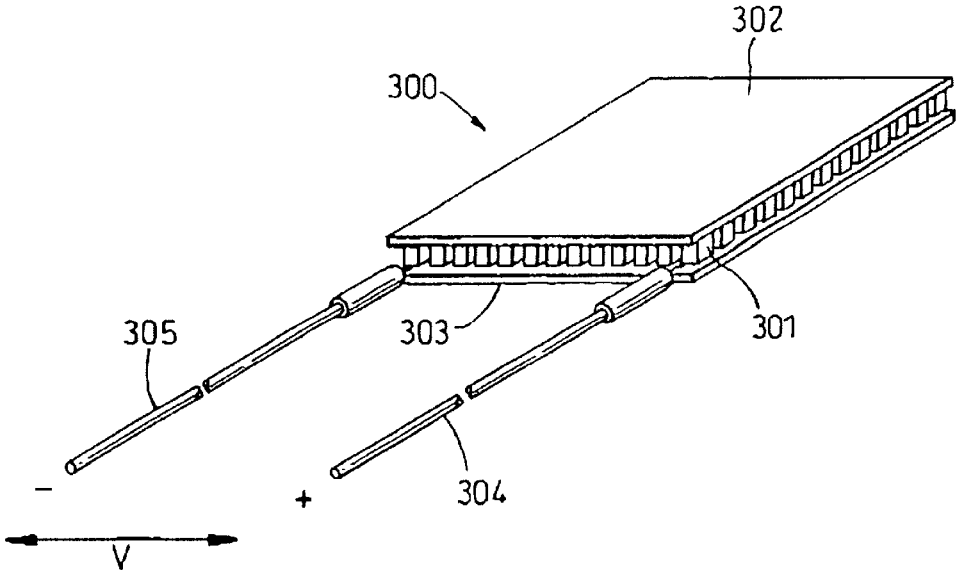
FIG. 13 is a schematic perspective view of a cooling unit containing the Peltier junction of FIG. 12.

The several heat-exchangers are operated by means of Peltier coolers, the principle of which is shown in FIGS. 12 and 13.

Referring to FIG. 12, a power source 200 is provided to power the junction 202 of two dissimilar materials. In the preferred embodiment, doped semiconductors arc used: one portion of an n-doped semiconductor 204 and one portion of a p-doped semiconductor 206. These two dissimilar materials are joined to each other by a joining conductor 208 and to the circuit by conductors 210, 212.

Because of the Peltier effect which exists between dissimilar materials when a current is passed through the circuit from the power supply 200 the joining conductor 208 experiences a heating effect and the conductors 210, 212 experience a cooling effect.

Referring to FIG. 13, a thermoelectric module 300 consists of a plurality of conductivity elements 301 held between a pair of ceramic plates 302 and 303.

A voltage V is provided by way of positive and negative supply leads, 304 and 305 respectively.

The arrangement of the elements 301 is such that plate 302 acts as a heating-absorbing (cooling) device and plate 303 acts as a heat-releasing (heating) surface.

Examples of how apparatus, incorporating one or more Peltier junctions according to the present invention, may be used in other applications include, but are not limited to, the following.

a) Cooling/chilling
- ice cream and frozen food vending;
- domestic refrigeration, drinks chillers, wine coolers etc,
- transport refrigeration (refrigerators in cars, planes, trucks and ships);
- industrial machinery cooling (injection moulding machines, laser cutting tools, metal and woodworking machinery, industrial drills and rock-cutting equipment, food processing plant and equipment);
- specialist applications for the transport of organs, bodies etc.

b) Air conditioning
- telecommunications and power supply equipment;
- broadcasting and lighting equipment;
- automotive and transport;
- domestic/localised cooling.

c) Heating/warming
- automotive and transport;
- catering hot-plates and cabinets;
- paint tin warmers and warming ovens/dryers in industrial applications;
- washing machines;
- heat curing systems for resins and epoxies.

Pettier plates can be used in conjunction with one or more coolants (water, gas, air) for different applications within the same system (heating, air conditioning and heating). An example of this is a vehicle using the same system to power a mini-refrigerator, an air-conditioning system and a seat-heating system.

The apparatus according to the present invention does not require any chloro-fluorocarbon coolants and in use does not generate environmentally-unacceptable emissions (such as the so-called "greenhouse gases").

What is claimed is:

1. An apparatus for providing localized heat transfer to or from a beverage, comprising:

beverage-containing means for containing the beverage;

dispensing means, for dispensing the beverage;

delivery means, disposed between said beverage-containing means and said dispensing means, for continuously delivering the beverage from said beverage-containing means to said dispensing means;

at least one heating/cooling unit including at least one Peltier junction, operationally coupled to said dispensing means, for heating/cooling said beverage in the proximity of said dispensing means;

a heat-transfer agent, coupled to said at least one heating/cooling unit, for transferring heat from said at least one heating/cooling unit;

venting means, operationally coupled to said heat-transfer agent, for venting the transferred heat; and power supply means, operationally coupled to said heating/cooling unit, for supplying power to said at least one Peltier junction.

2. The apparatus of claim 1, further comprising insulating means, coupled to said beverage-containing means, for providing insulation.

3. The apparatus of claim 2, wherein said insulating means comprises a jacket for surrounding said beverage-containing means.

4. The apparatus of claim 1, wherein said beverage-containing means comprises either of a barrel and a keg.

5. The apparatus of claim 1, wherein said delivery means comprises either of a duct and a pipe.

6. The apparatus of claim 1, further comprising at least one heating/cooling unit operationally coupled to said beverage containing means for heating/cooling said beverage.

7. The apparatus of claim 1, further comprising at least one heating/cooling unit operationally coupled to said delivery means for heating/cooling said beverage.

8. The apparatus of claim 1, wherein said delivery means comprises Python coaxial tubing.

9. The apparatus of claim 8, wherein said heat transfer agent consists essentially of a fluid.

10. The apparatus of claim 9, wherein said fluid is water.

11. The apparatus of claim 9, wherein said fluid is continuously re-circulated.

12. The apparatus of claim 9, wherein said fluid is pressurized to less than 2.5 bars.

13. The apparatus of claim 1, further comprising pumping means, operationally coupled to said beverage-containing means, for pumping said beverage to said dispensing means.

14. The apparatus of claim 1, wherein said venting means comprises a radiator.

15. The apparatus of claim 14, wherein said radiator is fan-assisted.

16. The apparatus of claim 1, wherein said power supply means comprises a mains-fed transformer.

17. The apparatus of claim 1, further comprising auxiliary power means.

18. The apparatus of claim 17, wherein said auxiliary power means comprises at least one battery.

19. The apparatus of claim 1, wherein said at least one heating/cooling unit is adapted to allow for choosing a desired temperature to which said beverage is chilled.

20. The apparatus of claim 19, wherein said desired temperature is in the range from −12° C. to +12° C.

21. The apparatus of claim 19, wherein said desired temperature is in the range from +2° C. to +8° C.

22. The apparatus of claim 1, wherein said at least one Peltier junction comprises at least one n-doped region and at least one p-doped region.

23. The apparatus of claim 1, wherein said beverage flows through said delivery means at a pre-determined rate.

24. The apparatus of claim 23, wherein said rate flow is at least 600 cm3 per minute.

25. The apparatus of claim 23, wherein said rate flow is at least 1200 cm3 per minute.

26. The apparatus of claim 23, wherein said rate flow is at least 2400 cm3 per minute.

27. The apparatus of claim 23, wherein said rate flow is in the range between 3000 cm3 and 4000 cm3 per minute.

* * * * *